US009401253B2

(12) United States Patent
Piekarski et al.

(10) Patent No.: US 9,401,253 B2
(45) Date of Patent: Jul. 26, 2016

(54) QUENCHING CHAMBER OF A MEDIUM-VOLTAGE SWITCH DISCONNECTOR

(71) Applicant: ABB TECHNOLOGY AG, Zurich (CH)

(72) Inventors: Piotr Piekarski, Mlawa (PL); Zbigniew Domurad, Ostroleka (PL); Adam Kowalski, Ostroleka (PL)

(73) Assignee: ABB TECHNOLOGY AG, Zurich (CH)

( * ) Notice: Subject to any disclaimer, the term of this patent is extended or adjusted under 35 U.S.C. 154(b) by 0 days.

(21) Appl. No.: 14/428,446

(22) PCT Filed: Aug. 14, 2013

(86) PCT No.: PCT/EP2013/002436

§ 371 (c)(1),
(2) Date: Mar. 16, 2015

(87) PCT Pub. No.: WO2014/048523

PCT Pub. Date: Apr. 3, 2014

(65) Prior Publication Data

US 2015/0279594 A1 Oct. 1, 2015

(30) Foreign Application Priority Data

Sep. 26, 2012 (EP) ..... 12460069

(51) Int. Cl.
*H01H 33/74* (2006.01)
*H01H 33/77* (2006.01)
(Continued)

(52) U.S. Cl.
CPC ..... *H01H 33/74* (2013.01); *H01H 33/10* (2013.01); *H01H 33/18* (2013.01); *H01H 33/77* (2013.01); *H01H 9/302* (2013.01); *H01H 2033/085* (2013.01)

(58) Field of Classification Search
CPC ..... H01H 33/10; H01H 33/18; H01H 33/74; H01H 33/77; H01H 33/76; H01H 2033/085; H01H 9/302
USPC ..... 218/34, 46, 81, 76, 85, 90, 150; 335/201
See application file for complete search history.

(56) References Cited

U.S. PATENT DOCUMENTS 2,757,262 A * 7/1956 Yeamans ..... H01H 73/18 218/89
3,377,447 A 4/1968 Hermann et al.
(Continued)

FOREIGN PATENT DOCUMENTS

DE 195 18 051 11/1996 ..... H01H 9/34
EP 0 959 483 11/1999 ..... H01H 9/34

OTHER PUBLICATIONS

International Search Report mailed Oct. 31, 2013 in corresponding application No. PCT/EP2013/002436.
(Continued)

*Primary Examiner* — Renee Luebke
*Assistant Examiner* — William Bolton

(57) ABSTRACT

A quenching chamber in medium-voltage switch disconnectors includes a body made of a gassing material that is of a solid shape similar to a rectangular prism. The chamber includes an arcing knife channel and an arc chamber hollowed in the body and is fitted with an arcing contact unit located in a socket. The arc chamber extends directly along the arcing knife channel from a back wall of the chamber and is connected with the inside of the arcing knife channel through a gap that forms a flat funnel. The height of the funnel decreases with an increase in the distance to the arcing knife channel. The width of the gap is less than the width of the arcing knife channel measured in a plane perpendicular to the side walls of the body.

13 Claims, 6 Drawing Sheets

(51) Int. Cl.

| | |
|---|---|
| ***H01H 33/10*** | (2006.01) |
| ***H01H 33/18*** | (2006.01) |
| ***H01H 9/30*** | (2006.01) |
| ***H01H 33/08*** | (2006.01) |

(56) References Cited

U.S. PATENT DOCUMENTS

| | | | | |
|---|---|---|---|---|
| 3,452,172 | A | 6/1969 | Kesselring et al. | |
| 3,859,487 | A | 1/1975 | Berberich | 200/144 R |
| 4,393,288 | A * | 7/1983 | Belttary | H01H 73/18 218/155 |
| 6,373,016 | B2 * | 4/2002 | Brouillat | 218/154 |
| 2009/0145882 | A1 * | 6/2009 | Birner | H01H 9/34 218/40 |

OTHER PUBLICATIONS

Written Opinion mailed Oct. 31, 2013 in corresponding application No. PCT/EP2013/002436.

* cited by examiner

A – A

B – B

QUENCHING CHAMBER OF A MEDIUM-VOLTAGE SWITCH DISCONNECTOR

CROSS-REFERENCE TO RELATED APPLICATION

This is a §371 application of International patent application number PCT/EP2013/002436 filed Aug. 14, 2013, which claims the benefit of European patent application No. 12460069.3 filed on Sep. 26, 2012, and which are incorporated herein by reference.

TECHNICAL FIELD

The invention deals with a quenching chamber applicable in medium-voltage switch disconnectors, designed for multiple interruptions of currents in single- or multiphase electric circuits in operating state and for occasional disconnection of overload currents.

BACKGROUND ART

The processes of quenching of work currents and overload currents differ in the energy of the electric arc initiated in the chamber. In the space where the electric arc acts on the chamber elements made of gassing materials, there are generated gasses which are used to cool the electric arc by absorbing thermal energy from the arc column. The larger the thermal energy of the arc, the more intensive gassing in the chamber.

A design of a quenching chamber comprising gassing plates arranged parallel to each other and pressed to each other by springs fixed in the chamber is known from European patent description EP0959483. The arcing knife of the switch attached to the switch arm is inserted between these plates, the switch functioning together with the chamber. The insertion of the arcing knife causes that the gassing plates move away from each other. The space formed by the separation of the gassing plates is the arcing knife channel. An electric arc is generated in the arcing knife channel when the switch is being opened in work or in overload conditions. The electric arc channel spreads along the arcing knife channel. As a result of the thermal action of the electric arc on the surfaces of the gassing plates the ablation phenomenon occurs, which consists in gassing of surfaces made of gassing materials. The generated gases cool down the electric arc by absorbing thermal energy from the arc column. As a result of gassing, gas pressure in the arc channel grows. These gasses are ejected into the decompression part of the quenching chamber situated above the part in which the gassing plates are fixed, and then, through an outlet located over the decompression part of the quenching chamber, they are ejected outside the quenching chamber. The quantity of ejected gases is limited by using an element which closes the outlet from the chamber after the arcing knife moves out. The functioning of the chamber while work and overload currents are interrupted consists in cooling the electric arc using the ablation phenomenon amplified by pressing the gassing plates on the arc column.

An inconvenience of that solution is that the arc channel corresponds to the arcing knife channel, which means that the distance between the gassing surfaces and the axis of the electric arc column is dependent on the dimensions of the arcing knife, which causes that the maximum intensity of gassing of the gassing plates of the quenching chamber is not ensured, which results in a reduction in the switching parameters of the quenching chamber. The fact that the arcing knife channel corresponds to the arc channel leads to degradation of the arc channel walls caused by the arc burning always in the same channel. This makes the ablation conditions worse over the life of the chamber. In addition, if the chamber operates in overload conditions, when the arc energy is the greatest, the distance between the gassing plates can increase. This happens due to the pressure occurring inside the chamber, if the force acting on the plates, directly proportional to the pressure of the generated gasses, is larger than the force of the springs supporting the gassing plates.

Another inconvenience of that solution is the fact that in order to reduce the quantity of ionized gases ejected towards the burning arc during the opening of the switch, movable elements closing the chamber after the exit of the arcing knife are used. The moving elements can be blocked by dirt or deformation, which causes that they will not serve their purpose i.e. they will not reduce the quantity of ejected gasses, but they can also lead to the switch failure by blocking the entrance into the arcing knife channel and thus disabling the proper functioning of the apparatus.

The presented solution employs only the phenomenon of arc quenching by cooling the arc column with gases. The use of only the phenomenon of arc column cooling results in a reduction in the switching parameters of quenching chambers. For that reason, in order to increase the switching parameters of quenching chambers made of gassing materials, there is a need to use the electric arc lengthening and flattening effect in such chambers, which will improve the arc quenching efficiency and thereby the chamber operation efficiency and will increase the switching parameters of a quenching chamber with gassing plates.

A design of a quenching chamber with magnetic blow-out of the arc, comprising a blowout coil and insulating plates suitably shaped and fixed to form narrow gaps, is known from patent description DE 19518051. The essential feature of electric arc quenching in this case is an increased power reception from the arc resulting from its lengthening. The arc is forced to increase its length and to move in the chamber through a magnetic field caused by the breaking current. The right direction of winding of the blowout coil ensures that the created electromagnetic force will push the arc column from the arcing knife channel to the quenching chamber.

SUMMARY OF THE INVENTION

In the presented design, the number of elements being part of the chamber is large, which greatly extends the chamber production time and the degree of complication of the production process. For that reason, there is a demand for a quenching chamber which does not comprise additional elements such as a blowout coil or insulating plates, but which is made of a gassing material, and in which the phenomenon of electric arc elongation would be used with a simultaneous use of the ablation phenomenon.

The essential feature of the quenching chamber of a medium voltage switch disconnector, whose body is formed of a gassing material into a solid of a shape similar to a rectangular prism having a top wall, a bottom wall, a front wall, a back wall, and side walls, comprising an arcing knife channel, an arc chamber and a socket, all three being hollowed in the body, and furnished with an arcing contact unit located in the socket, is that the arc chamber extends directly along the arcing knife channel, from the back wall of the chamber, and it is connected with the inside of the arcing knife channel by a gap of a width of "s", forming a flat funnel. The height "h" of the funnel, in a plane parallel to the side walls, decreases with an increase in the distance from the arcing knife channel. The width "s" of the gap in a plane perpendicular to the surface of the side walls is less than the width of the arcing knife channel measured in a plane perpendicular to the side walls of the body of the quenching chamber.

Preferably, the end of the arc chamber is connected with the blow-out channel situated in the chamber body and ending with an elongated outlet, and the width "s" of the blow-out channel in a plane perpendicular to the surfaces of the side walls of the body increases with the distance to the outlet of the arc chamber.

Preferably, in the first embodiment of the invention, the side walls of the chamber body have holders that are situated near the bottom wall, opposite to each other in a mirror image position.

Preferably, in the second embodiment of the invention, the chamber body is located in a cassette forming the insert of the cassette, which cassette has outer walls, a top wall, a bottom wall, a front wall, a back wall, and two side walls, which are adjusted to the body walls, respectively. In this embodiment of the invention, the end of the arc chamber is connected with the blow-out channel situated in the cassette and ending with an elongated outlet, and the width "G'" of the blow-out channel in a plane perpendicular to the surfaces of the side walls of the body increases with the distance to the arc chamber outlet.

Preferably, the side walls of the cassette have holders that are situated near the bottom wall of the cassette, opposite to each other in a mirror image position.

Preferably, in both embodiments of the invention, there are notches in the form of grooves made on the inner surface of the arc chamber, which notches are arranged longitudinally to the direction of the outlet of the gasses from the arcing knife channel.

Preferably, the quenching chamber cassette is made as a resin casting.

Preferably, the quenching chamber body situated in the cassette has a spline situated in the top wall of the body.

Preferably, in the quenching chamber body situated in the cassette, below the spline situated on the top wall of the body, there is a groove used to fix a gasket.

Preferably, the spline situated on the top wall of the body situated in the cassette has inside ribs.

Preferably, in both embodiments of the invention, in the socket of the chamber body, at the place where the arcing contact connection is installed, there is a groove used to fix a gasket.

Preferably, in both embodiments of the invention, the body of the quenching chamber is formed from two shaped plates adhering to each other and non-permanently connected in a plane parallel to the side walls of the body.

The advantage of the quenching chamber according to the invention is its simple design permitting improvement in the process of quenching an arc initiated in the arcing knife channel, which improvement is achieved due to simultaneous elongation and flattening of the arc column by pushing the arc column out from the arcing knife channel to the arc chamber, with a resultant improvement in the effectiveness of gassing of the surfaces of the gassing plates. The quenching chamber according to the invention improves the reliability of the switch disconnector, because even at low-volume currents the arc column is completely pushed outside the arcing knife channel, considerably reducing degradation of the arcing knife channel, which affects the chamber life. The design of the quenching chamber according to the invention allows to direct the blow-out of the gasses generated in the quenching-chamber gassing process in such way that the direction of the blow-out of gasses does not coincide with the direction of movement of the arcing knife of the switch. Blow-out gasses are pushed out of the arc chamber area in the direction from the arcing knife channel to the blow-out channel, which to a large extent prevents the occurrence of secondary ignition. An advantage of the quenching chamber according to the second embodiment of the invention is its design which allows, after repeated tripping of the switch, replacement of the used chamber with a new one by simply pulling the chamber body from the cassette and sliding the new body in.

BRIEF DESCRIPTION OF THE DRAWINGS

The invention is explained in embodiments in the drawing, where.

BEST MODE FOR CARRYING OUT THE INVENTION

Figure 1:
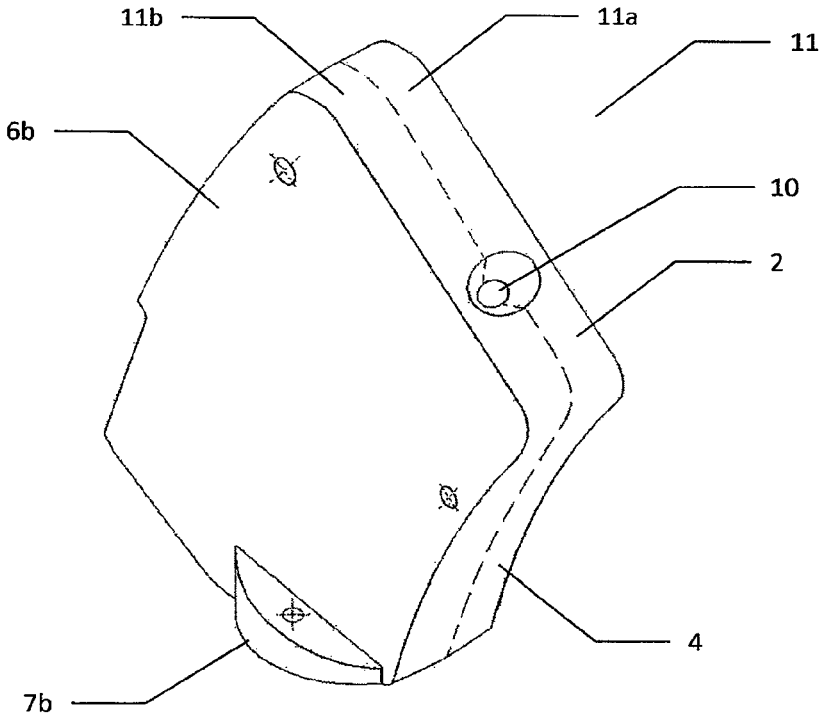
FIG. 1—shows the front view of the quenching chamber in the first embodiment of the invention, in perspective view, FIG. 2—shows the back view of the quenching chamber in the first embodiment of the invention, in perspective view, FIG. 3—shows the front view of the quenching chamber body in the second embodiment of the invention, in perspective view, FIG. 4—shows the back view of the quenching chamber body in the second embodiment of the invention, in perspective view, FIG. 5—shows the front view of the cassette of the quenching chamber in the second embodiment of the invention, in perspective view, FIG. 6—shows the front view of the quenching chamber in the second embodiment of the invention, in perspective view, FIG. 7—shows the back view of the quenching chamber in the second embodiment of the invention, in perspective view, FIG. 8—shows the body of the quenching chamber, in the first embodiment of the invention, without taking into account the arcing contact unit, in a section along the line dividing the body into two symmetrical halves, FIG. 9—shows the body of the quenching chamber, in the first embodiment of the invention, together with the arcing contact unit, in a section along the line dividing the body into two symmetrical halves, FIG. 10—shows the body of the quenching chamber, in the second embodiment of the invention, together with the arcing contact unit, in a section along the line dividing the body into two symmetrical halves, FIG. 11—shows the quenching chamber from FIG. 2, in section A-A in a plane parallel to the top wall of the body, FIG. 12—shows the quenching chamber from FIG. 7, in section B-B in a plane parallel to the top wall of the body.
Figure 2:
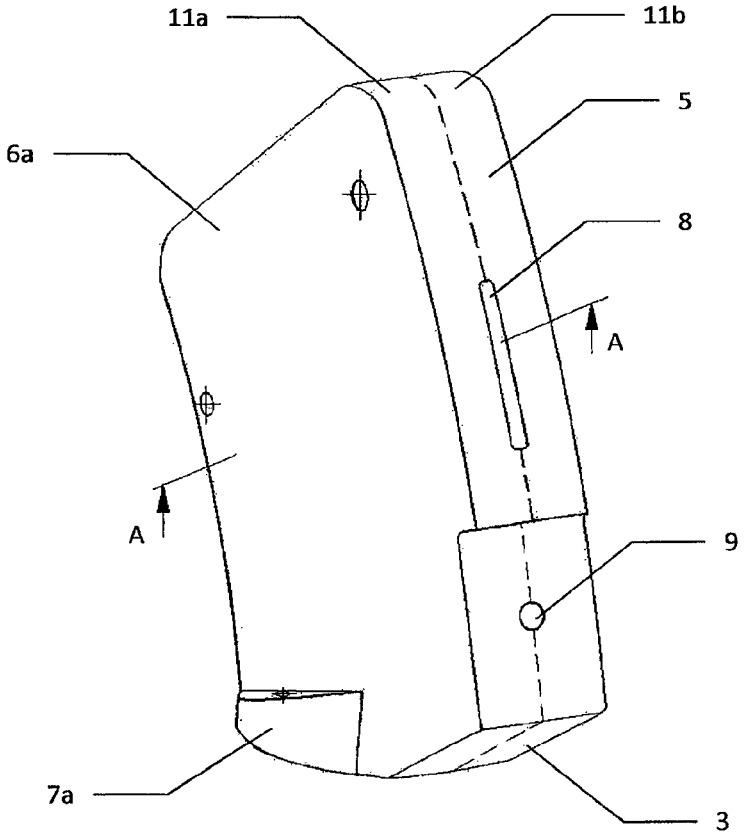
Figure 3:
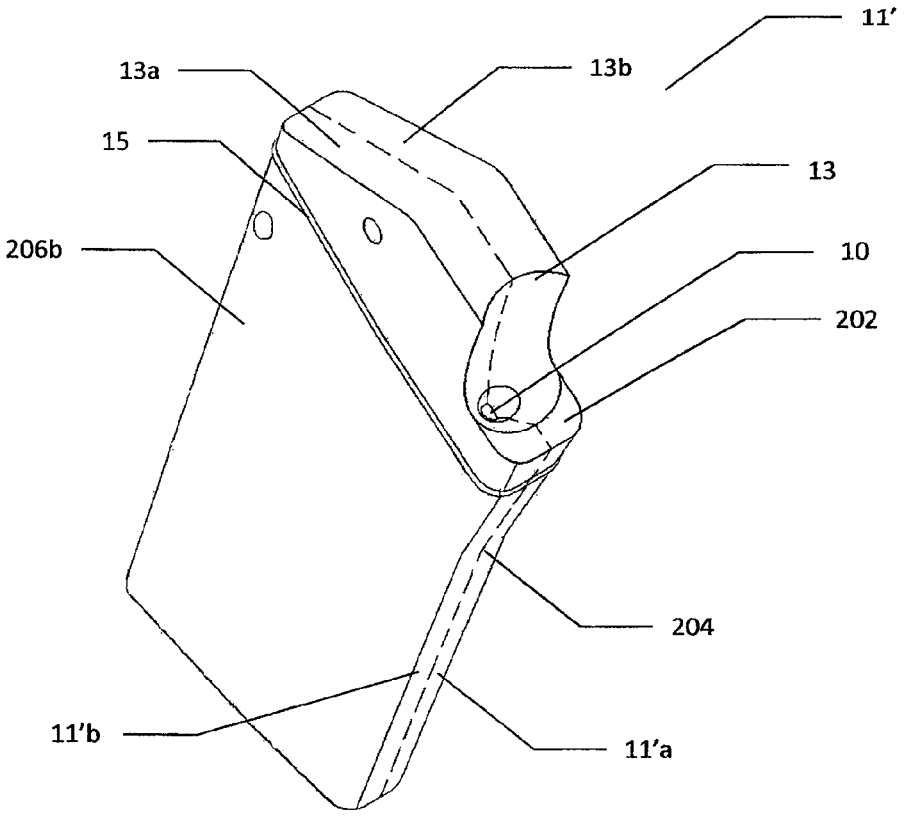
Figure 4:
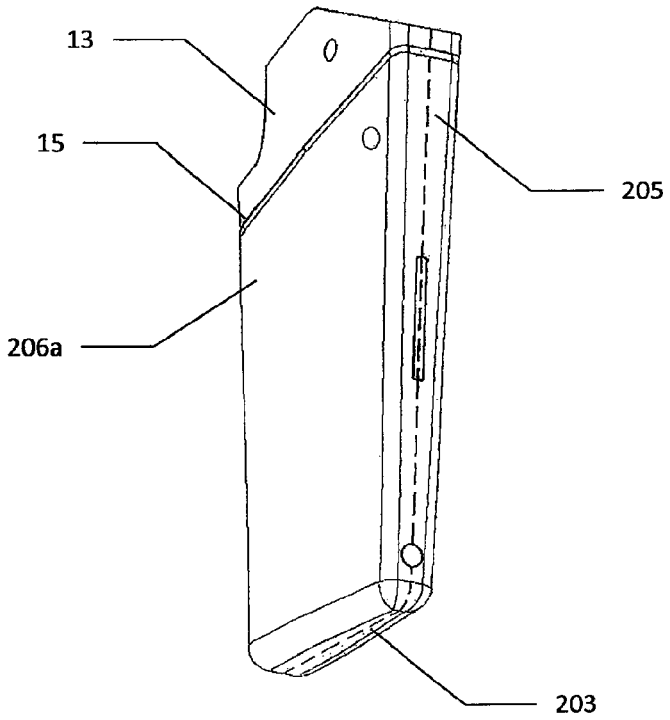
Figure 5:
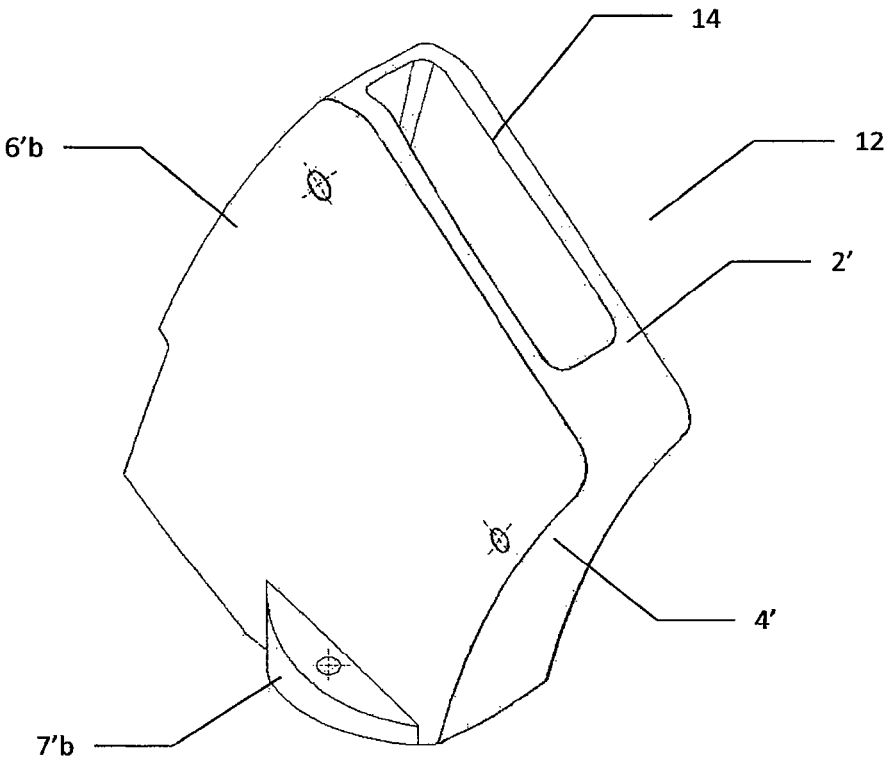
Figure 6:
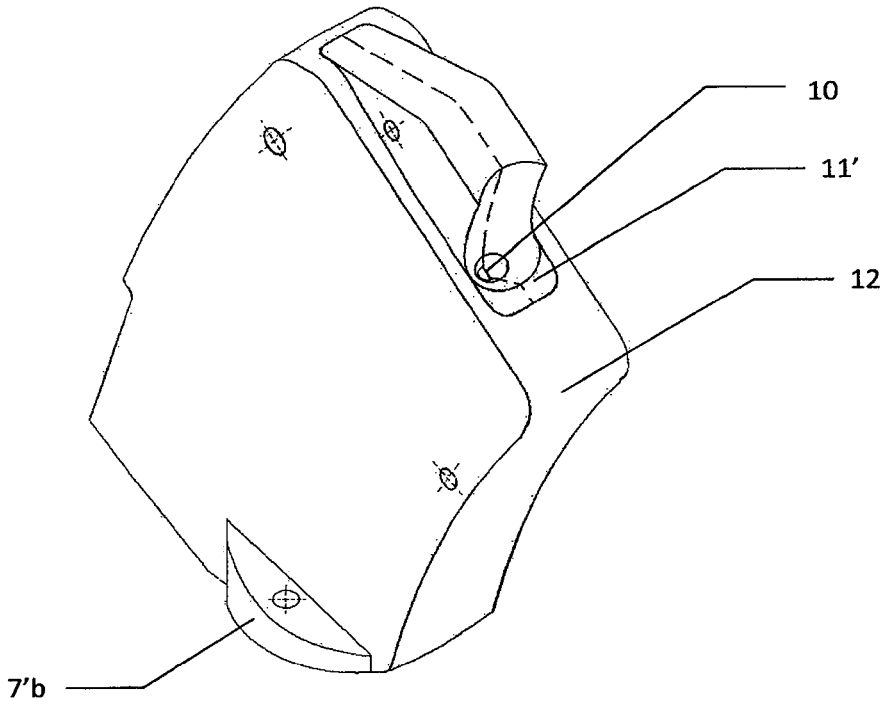
Figure 7:
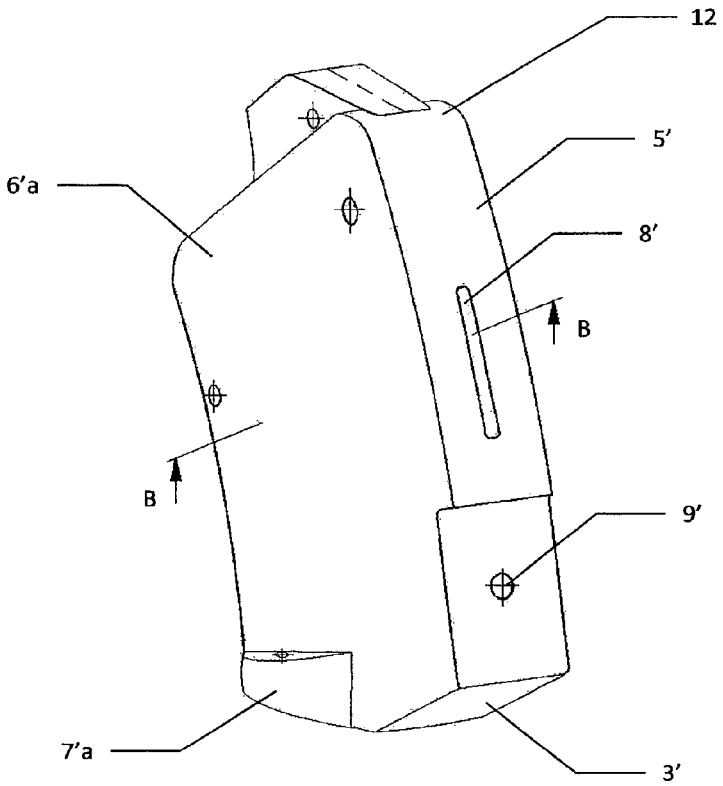
Figure 8:
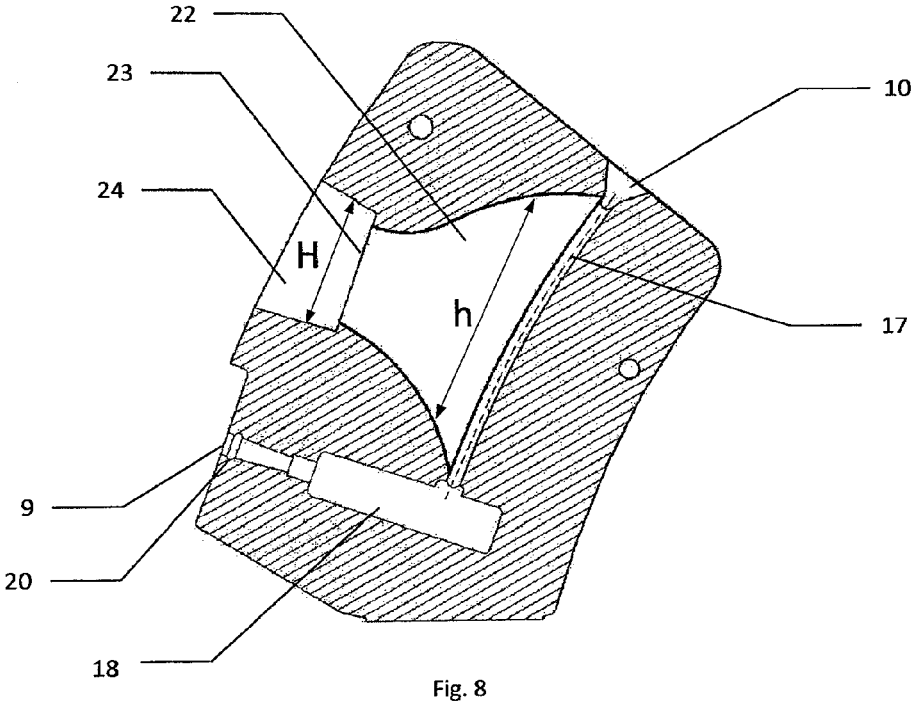
Figure 9:
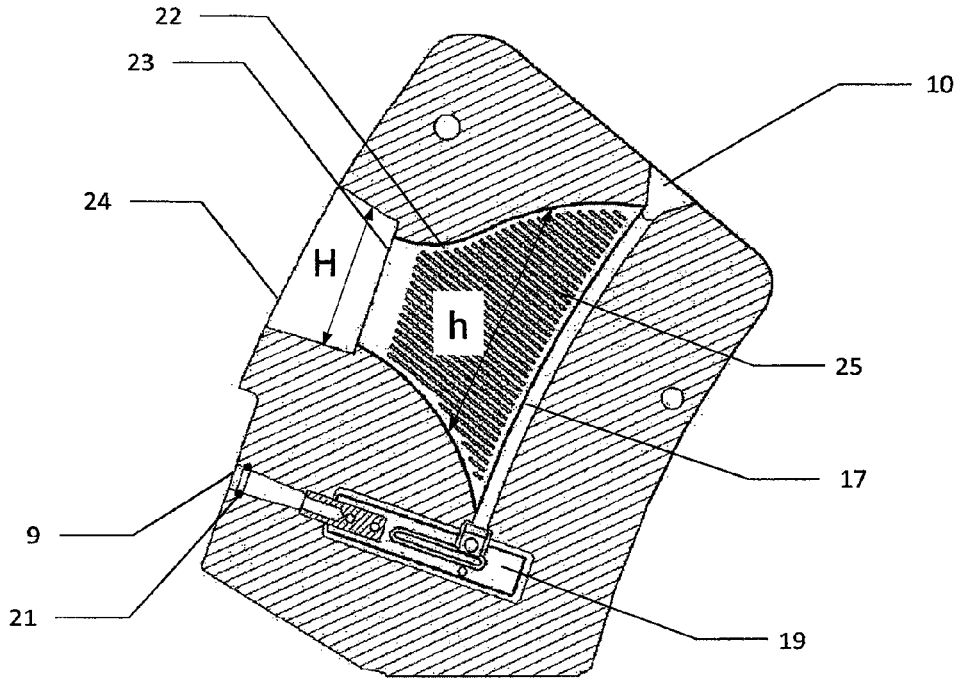
Figure 10:
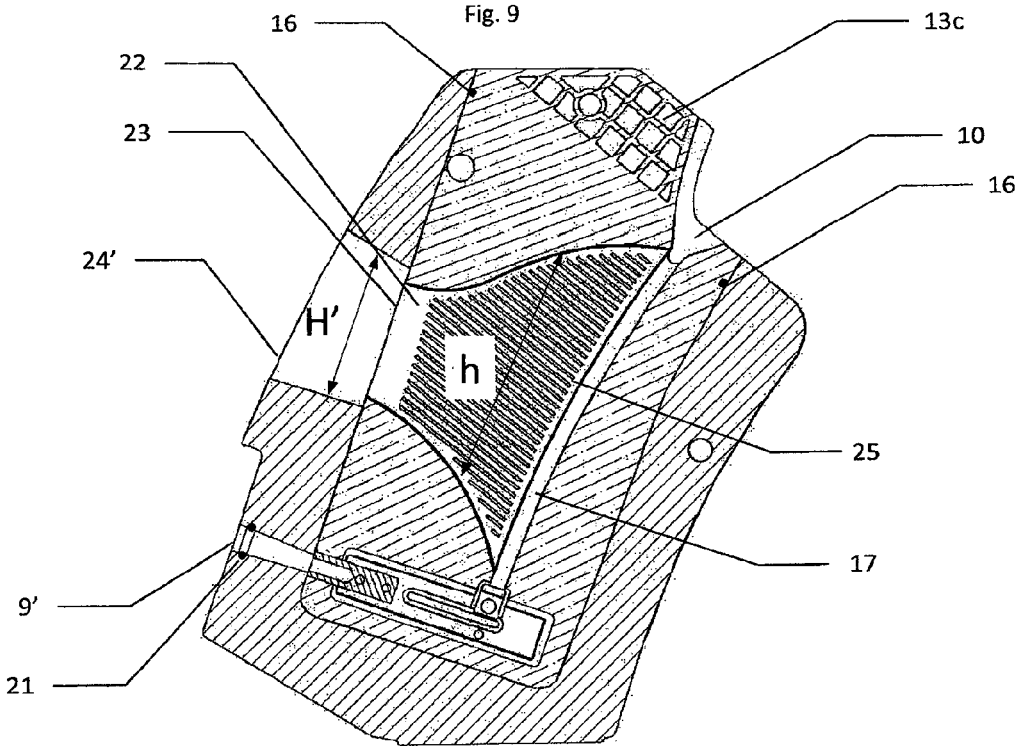
Figure 11:
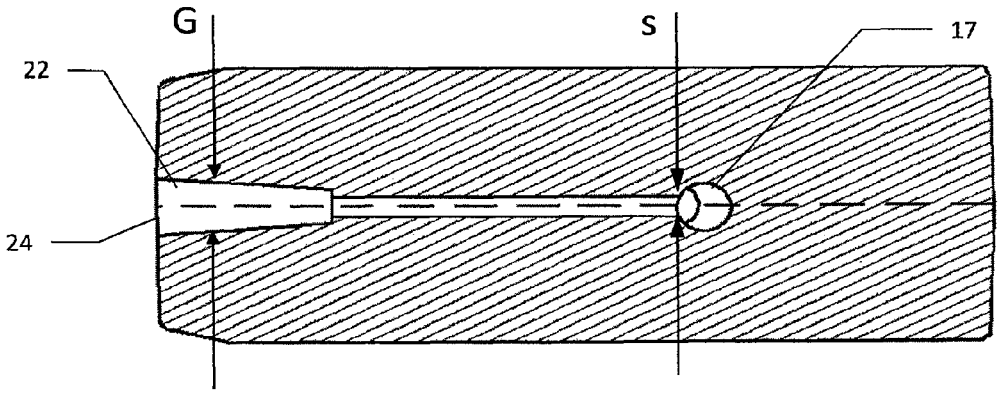
Figure 12:
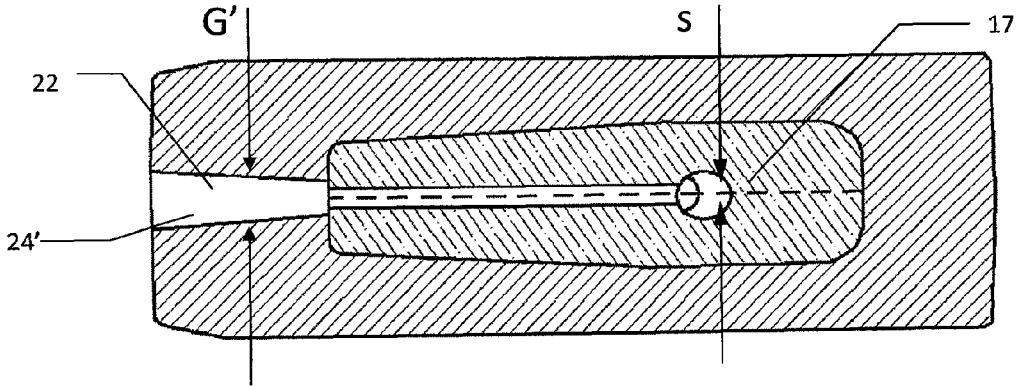

The quenching chamber 1 in the first embodiment of the invention and in the first version of this embodiment is formed in the shape of a solid of a gassing material, which solid has a shape similar to a rectangular prism with a top wall 2, a bottom wall 3, a front wall 4, a back wall 5 and two side walls 6*a* and 6*b*. The dashed line indicates that the quenching chamber can be made in the second version of the embodiment in the form of two symmetrical halves permanently joined with each other by screwing. Assembly openings in the side walls are indicated by the symbols of a circle and a cross in the drawing.

The side walls 6*a* and 6*b* in both versions of the first embodiment of the invention have holders 7*a* and 7*b* situated near the bottom wall 3, opposite to each other in a mirror image position. The holders 7*a* and 7*b* are used to fix the quenching chamber 1 to a post insulator of the switch disconnector, not shown in the drawing, and they are provided with assembly openings, indicated by the symbols of a circle and a cross in the drawing.

In the middle of the back wall 5, an outlet 8 intended for letting out gasses from the inside of the quenching chamber is longitudinally situated. In the back wall 5, near the bottom wall 3, there is situated a port 9 for an electric connection of the switch disconnector, not shown in the drawing.

In the top wall 2, near the front wall 4, there is an inlet/outlet 10 of the arcing knife of the switch disconnector, not shown in the drawing, which knife can be made from a bar, or flat sheet metal, or a flat bar and it moves inside the quenching chamber by means of a revolving mechanism of the switch disconnector, not shown in the drawing, according to the knife trajectory designed for the given type of switch.

In the second version of the first embodiment, the quenching chamber 1 comprises a body 11 preferably made from two shaped plates 11*a* and 11*b* joined non-permanently and adhering to each other with the larger surfaces basically parallel to side walls 6*a* and 6*b*. The non-permanent joining of the plates 11*a* and 11*b* is achieved by screwing the two plates with each other through assembly openings, indicated by symbols in the drawing.

In the second embodiment of the invention, the body 11' does not have the holders 7*a* and 7*b* and it is located in a casing forming a cassette 12, and the volume of the solid which is the body 11' is significantly reduced as a result of cutting a layer of the material of the body off the walls 2, 3, 4, 5, 6*a* and 6*b* of the body 11 and creating new walls, i.e. a top wall 202, a bottom wall 203, a front wall 204, a back wall 205 and two side walls 206*a* and 206*b*. The thickness of the cut-off layers can be different for individual walls. In the second embodiment of the invention, similarly to the first one, the body 11' can be made in the first version in the form of a solid or in the second version in the form of two symmetrical halves permanently joined with each other by screwing, which is indicated in the drawing by the dashed line. The top wall 202 has a spline 13 which can be made as an openwork structure. Below the spline 13 in the body 11' there is a groove 15 used to fix a gasket 16. The inlet/outlet 10 of the arcing knife in the second embodiment of the invention is situated in the body 11' at the base of the spline 13, in the top wall 202.

In the second version of the second embodiment of the invention, the body 11' is formed of two shaped plates 11'*a* and 11'*b*, non-permanently connected, adhering to each other with the larger surfaces, basically parallel to the side walls 206*a* and 206*b*. The spline 13 consists of halves 13*a* and 13*b* which are elements of the plates 11'*a* and 11'*b*, respectively, and they are situated symmetrically relative to each other forming a mirror image. The splines 13*a* and 13*b* are used to non-permanently join the plates 11'*a* and 11'*b* with each other and they can be made as an openwork structure consisting of internal ribs 13*c*. The ribbings 13*c* reduce the weight of the quenching chamber.

The cassette 12 comprises external walls, i.e. a top wall 2', a bottom wall 3', a front wall 4', a back wall 5' and two side walls 6'*a* and 6'*b*, corresponding exactly to the walls 2, 3, 4, 5, 6*a* and 6*b* of the body 11. Internal walls of the cassette 12 correspond exactly to the walls of the body 11' after the cutting-off, i.e. they correspond to the bottom wall 203, the front wall 204, the back wall 205 and the side walls 206*a* and 206*b*. The side walls 6'*a* and 6'*b* of the cassette 12 are provided with holders 7'*a* and 7'*b* which are situated near the bottom wall 3', opposite to each other in a mirror image position. The holders 7'*a* and 7'*b* correspond to the side holders 7*a* and 7*b* and they are used to fix the cassette 12 to the post insulator of the switch disconnector, not shown in the drawing, and they are provided with assembly openings, marked by the symbols of a circle and a cross in the drawing. The cassette 12 is provided with a cassette opening 14 which is located in the top wall 2' of the cassette, through which the body 11' is inserted inside the cassette 12. In the middle of the back wall 5' of the cassette 12 there is a longitudinally situated outlet 8' coinciding with the opening 8 of the body 11, intended to let out gasses from the inside of the quenching chamber 1. In the back wall 5' near the bottom wall 3' there is situated a port 9' for the electric connection of the quenching chamber 1, which coincides with the port 9 in the body 11. The cassette 12 is made as a resin casting. The cassette 12, after the body 11' is slid inside it, is a solid of a shape and volume corresponding to the shape and volume of the body 11. Owing to this, the quenching chamber in both embodiments of the invention can be used for identical switch disconnectors. The second embodiment of the invention additionally makes it possible to replace the body 11' of the chamber after repeated tripping of the switch disconnector, without the need to dismount the cassette 12 from the switch insulator, not shown in the drawing.

In both embodiments of the invention, both in the first and in the second version of the embodiment, the body 11 or 11' contains an arcing knife channel 17 hollowed inside it and extending from the inlet of the arcing knife 10 to a socket 18 hollowed in the body 11 or 11' and used to fix an arcing contact unit 19 in it. The channel 17 has a longitudinal axis which is a circular arc of a radius compatible with the circular arc of the trajectory of the arcing knife of the switch disconnector, not shown in the drawing. For an arcing knife made from a round bar, the channel has the cross-section in the shape of a circle, and for an arcing knife made from sheet metal or from a flat bar it has the shape of a rectangle. In the example embodiment, the socket 18 is made by hollowing out the material in the body 11 or in the body 11' and it is situated perpendicular to the back wall 5 or 205. The socket 18 houses the arcing contact unit 19. The socket 18 is connected with the port 9 or 9' of the switch disconnector connection, not shown in the drawing.

In the socket 18, near the port 9 or 9', there is a groove 20 used to fix a gasket 21 used to seal the connections between the arcing contact unit 19 and the electric connection of the switch disconnector, not shown in the drawing, which connection is inserted through the port 9 or 9'. An arc channel 22 which forms a flat funnel whose height h, in a plane parallel to the surfaces of the side walls 6 of the body 11 or 6' of the cassette 12, respectively, decreases with the increase in the distance to the arcing knife channel 17, extends directly along the length of the arcing knife channel 17, from the back wall 5 or 205 of the chamber 1. The arc chamber 22 is connected with the inside of the arcing knife channel 17 through a gap of a width s, preferably, of a constant width less than the width of the arcing knife channel 17 measured in a plane perpendicular to the surfaces of the side walls 6 of the body 11 or 6' of the cassette 12 of the quenching chamber 1. The arc chamber 22 ends with an outlet 23. The outlet 23 is connected with the blow-out channel 24 which for the first embodiment of the invention extends from the end of the arc chamber 22 to the gas outlet 8 and which is made in the body 11. For the second embodiment of the invention the blow-out channel 24' extends from the end of the arc chamber 22 to the gas outlet 8' made in the cassette 12. The outlet 8, 8' in both embodiments has the shape of an elongated gap made in the back wall 5 of the body 11, or in the wall 5' of the cassette 12. The height H of the blow-out channel 24 or the height H' of the blow-out channel 24', measured in a plane parallel to the surfaces of the side walls 6 of the body 11 or the side walls 6' of the cassette 12, increases with the distance to the outlet 23 of the arc chamber 22. The width G of the blow-out channel 24 or the width G' of the blow-out channel 24', measured in a plane perpendicular to the surfaces of the side walls 6 of the body 11 or the side walls 6' of the cassette 12, increases with the distance to the arc chamber 22. The arc chamber 22 has grooves 25 to increase the active gassing surfaces of the body 11 or 11', which are arranged longitudinally to the direction of the outlet gasses from the arcing knife channel 17. The arcing knife channel 17 and the arc chamber 22 form an arc channel of the quenching chamber 1. In the conditions of practical application of the invention, the length of the arcing knife channel 17 is designed, taking into account the speed of the arcing knife inside the channel 17, to complete the arc quenching process before the moment of exit of the arcing knife from the arcing knife outlet 10 and, at the same time, to prevent a spontaneous reignition of the arc between the arcing knife and the arcing contact unit 19 after the exit of the arcing knife from the outlet 10.

In the invention operating conditions, the function of the quenching chamber is to quench the electric arc produced as a result of switching processes of a medium voltage switch disconnector. The process of interruption of currents that is executed in the quenching chamber consists in assisting in the quenching of the electric arc which is initiated at the moment of exit of the arcing knife from the arcing contact in specific voltage conditions. The assistance in the arc quenching consists in cooling, lengthening and flattening the electric arc. The cooling process is executed by gassing the material of the arc channel formed of the arcing knife channel 17 and of the arc chamber 22.

The effectiveness of the cooling process is improved by intensification of the gassing process in the arc chamber 22 as a result of an increase in the active surface of the gassing plates, which is achieved by grooving the grooves 25 in the surfaces of the arc chamber 22. The lengthening process is executed by pushing the arc out of the space of the arcing knife channel 17 to the arc chamber 22 owing to the limited volume of the arcing knife channel 17 and owing to the pressure which is generated there as a result of gassing of the gassing surfaces. The flattening of the arc is executed by the fact that the arc column pushed out of the arcing knife channel 17 to the arc chamber 22 has to adjust to the dimensions of the arc chamber 22, and more precisely, it is a result of pushing the arc column out into the arc chamber 22 space restricted by the width s of the gap. The flattening of the arc column causes that the gassing process is more effective due to an increase in the area of adherence of the arc column to the active gassing surface. The intensity of the above described electric arc quenching processes in the chamber depends on the switching current intensity, which causes that the process of overload current interruption differs from the process of work current interruption, and the difference is the consequence of different current values and thus of different values of pressure generated within the arcing knife channel 17, before the knife exits the channel 17, as a result of gassing of active surfaces. The design of the arcing knife channel 17 and of the blow-out channel 24 according to the invention ensures that both in the process of overload current interruption and in the process of work current interruption the arc column is pushed outside the arcing knife channel 17. For overload currents, the arc column is pushed into the arc chamber 22 farther from the arcing knife channel 17 than is the case for work currents. The distance to which the arc column is pushed depends on the value of pressure generated within the arcing knife channel 17. When the arc column is pushed into the arc chamber 22 which has a funnel-like shape, the arc column is lengthened, which helps the quenching process. Cooling, lengthening, and flattening of the arc column helps the quenching process.

LIST OF MARKINGS IN THE DRAWING

1—the quenching chamber
2 (202)—the top wall of the quenching chamber
3 (203)—the bottom wall of the quenching chamber
4 (204)—the front wall of the quenching chamber
5 (205)—the back wall of the quenching chamber
6 (6*a*, 6*b*) (206*a*, 206*b*)—the side walls of the quenching chamber
7 (7*a*, 7*b*, 7*a*', 7*b*')—the assembly holders of the quenching chamber
8 (8')—the outlet of the quenching chamber
9 (9')—the port for the electric connection of the switch
10—the inlet/outlet of the arcing knife
11, 11' —the body of the quenching chamber
11*a*, 11*b*—the shaped plates of the body 11
11'*a*, 11'*b*—the shaped plates of the body 11'
12—the cassette of the body 11'
2'— the external top wall of the cassette
3' —the external bottom wall of the cassette
4' —the external front wall of the cassette
5' —the external back wall of the cassette
6'(6*a*', 6*b*')—the external the side walls of the cassette
13—the spline of the cassette
13*a*, 13*b*—the halves of the spline of eh cassette
13*c*—the spline ribs
14—the cassette opening
15—the groove under the gasket in the cassette
16—the cassette gasket
17—the arcing knife channel of the switch
18—the socket of the arcing contact unit
19—the arcing contact unit
20—the groove under the gasket the socket of the arcing contact unit
21—the gasket of the socket of the arcing contact unit
22—the arc chamber
23—the outlet of the arc chamber
24—the blow-out channel in the body 11
24'—the blow-out channel in the cassette
25—the grooves of the arc chamber
s—the width of the arc chamber gap
h—the height of the arc chamber funnel
G, G' —the width of the blow-out channel
H, H' —the height of the blow-out channel

What is claimed is:

1. A quenching chamber of a medium voltage switch disconnector, whose body of a gassing material is formed into a solid of a shape similar to a rectangular prism having a top wall, a bottom wall, a front wall, a back wall and side walls, comprising a body having a hollow arcing knife channel, a hollow arc chamber and a hollow socket, and furnished with an arcing contact unit located in the hollow socket, characterized in that the hollow arc chamber extends directly along the hollow arcing knife channel, from the back wall of the chamber and the hollow arc chamber is connected within the hollow arcing knife channel by a gap of a width of (s), forming a flat funnel whose height in a plane parallel to a surface of each said side wall decreases with an increase in a distance to the hollow arcing knife channel, a width of the gap in a plane perpendicular to the surface of each said side wall being less than a width of the hollow arcing knife channel measured in a plane perpendicular to the side walls of the body, respectively.

2. A chamber according to claim 1, characterized in that an end of the arc chamber is connected with a blow-out channel situated in the body ending with an outlet, and a width of the blow-out channel in a plane perpendicular to the surface of each of the side walls of the body increases with a distance to the outlet of the arc chamber.

3. A chamber according to claim 1, characterized in that the side walls of the body are fitted with holders which are situated near the bottom wall, opposite to each other in a mirror image position.

4. A chamber according to claim 1, further comprising a cassette forming an opening to receive said body, wherein said cassette has external walls: a top wall, a bottom wall, a front wall, a back wall and two side walls, and such that said cassette's internal walls are adjusted to the walls of the body, respectively.

5. A chamber according to claim 4, characterized in that the end of the arc chamber is connected with a blow-out channel situated in the cassette and ending with an outlet, and a width of the blow-out channel in a plane perpendicular to the surface of each said side wall of the body increases with a distance to the outlet of the arc channel.

6. A chamber according to claim 4, characterized in that external side walls of the cassette are fitted with holders which are situated near the bottom wall opposite to each other in a mirror image position.

7. A chamber according to claim 1, characterized in that there are notches in the form of grooves on an inner surface of the body forming the hollow arc chamber, wherein said notches are arranged longitudinally to a direction of an outlet from the hollow arcing knife channel.

8. A chamber according to claim 4, characterized in that the cassette is made as a resin casting.

9. A chamber according to claim 4, characterized in that the body is fitted with a spline situated on the top wall of the body.

10. A chamber according to claim 9, characterized in that in the body of the quenching chamber, below the spline situated on the top wall of the body, there is a groove used to fix a gasket.

11. A chamber according to claim 9, characterized in that the spline is fitted with inner rib.

12. A chamber according to claim 1, characterized in that in the hollow socket of the arcing contact unit, at a place where an arcing contact connection is installed, there is a groove used to fix a gasket.

13. A chamber according to claim 1, characterized in that the body is formed from two shaped plates adhering to each other and non-permanently connected in a plane parallel to the side walls.

* * * * *